US011267030B2

(12) United States Patent
Angerer et al.

(10) Patent No.: US 11,267,030 B2
(45) Date of Patent: Mar. 8, 2022

(54) BACKGAUGE FOR A BENDING MACHINE AND METHOD FOR POSITIONING A BACKGAUGE OF THIS KIND

(71) Applicant: TRUMPF Maschinen Austria GmbH & Co. KG., Pasching (AT)

(72) Inventors: Gerhard Angerer, Altenberg (AT); Klemens Freudenthaler, Linz (AT); Florian Hausmann, Traun (AT); Matthias Hoerl, Linz (AT); Nenad Kovjenic, Linz (AT); Florian Maier, Leonding (AT); Verena Steininger, Linz (AT); Helmut Theis, Pfarrkirchen (AT); Manfred Waldherr, Linz (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 137 days.

(21) Appl. No.: 16/335,953

(22) PCT Filed: Oct. 13, 2017

(86) PCT No.: PCT/AT2017/060262
§ 371 (c)(1),
(2) Date: Mar. 22, 2019

(87) PCT Pub. No.: WO2018/068074
PCT Pub. Date: Apr. 19, 2018

(65) Prior Publication Data

US 2019/0217358 A1 Jul. 18, 2019

(30) Foreign Application Priority Data

Oct. 14, 2016 (AT) ..... A 50921/2016

(51) Int. Cl.
*B21D 5/00* (2006.01)
*B21D 43/26* (2006.01)
*B21D 5/02* (2006.01)

(52) U.S. Cl.
CPC ..... *B21D 5/004* (2013.01); *B21D 5/002* (2013.01); *B21D 5/02* (2013.01); *B21D 43/26* (2013.01)

(58) Field of Classification Search
CPC ..... B21D 5/004; B21D 5/002; B21D 5/02; B21D 5/0281; B21D 5/0209; B21D 43/26;
(Continued)

(56) References Cited

U.S. PATENT DOCUMENTS 4,089,200 A * 5/1978 Wingate ..... B21D 5/002 72/18.8
5,501,095 A 3/1996 Dilger et al.
(Continued)

FOREIGN PATENT DOCUMENTS

CN 103348075 A 10/2013
CN 105579651 A 5/2016
(Continued)

OTHER PUBLICATIONS

International Search Report in PCT/AT2017/060262, dated Feb. 19, 2018.

*Primary Examiner* — Teresa M Ekiert
*Assistant Examiner* — Teresa A Guthrie
(74) *Attorney, Agent, or Firm* — Collard & Roe, P.C.

(57) ABSTRACT

A back gauge for a back gauge positioning system of a bending machine includes a stop finger on which at least one stop surface is configured, and a base unit that is configured for coupling with the back gauge positioning system. The stop finger is coupled with the base unit by a linear guide,
(Continued)

Figure 1:
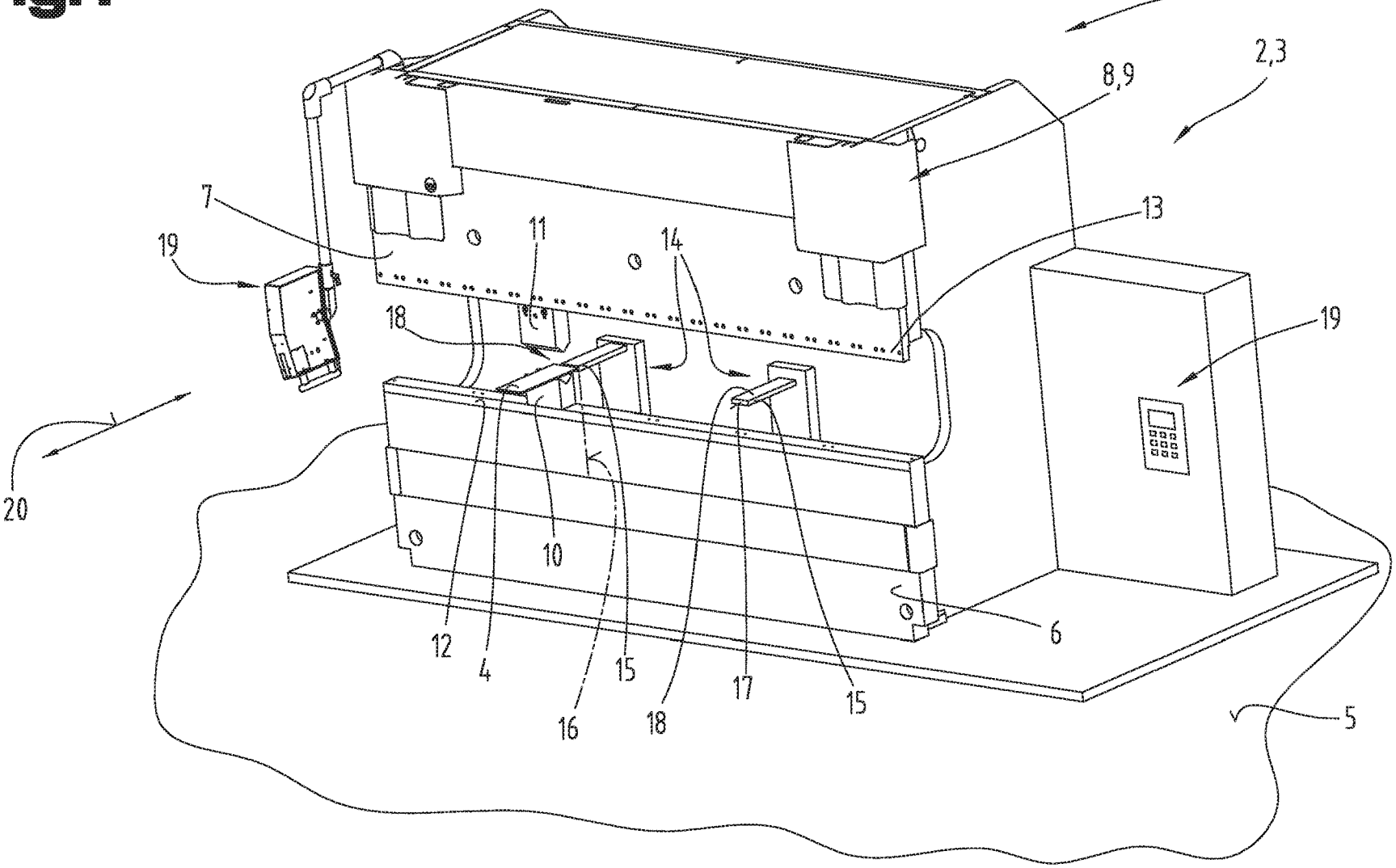

and the stop finger can be displaced relative to the base unit between a pushed-forward working position and a retracted position. The stop finger and the base unit are coupled with a first spring element, by which the stop finger is pre-loaded into its working position, and a locking device is configured, by which the stop finger can optionally be locked in the working position or is released into its retracted position for displacement counter to the spring force of the first spring element.

19 Claims, 11 Drawing Sheets

(58) Field of Classification Search
CPC ..... B21D 43/003; B21D 11/22; B21D 55/00; B21C 51/00
USPC ..... 72/21.4
See application file for complete search history.

(56) References Cited

U.S. PATENT DOCUMENTS

| | | | | |
|---|---|---|---|---|
| 8,683,835 | B2 * | 4/2014 | Austaller | B21D 5/002 72/31.1 |
| 10,030,684 | B2 | 7/2018 | Paquet | |
| 2005/0097940 | A1 | 5/2005 | Strasser et al. | |
| 2011/0048088 | A1 | 3/2011 | Austaller | |

FOREIGN PATENT DOCUMENTS

| | | | | |
|---|---|---|---|---|
| DE | 3739949 | C1 * | 3/1989 | B21D 55/00 |
| DE | 3739949 | C1 | 3/1989 | |
| DE | 602 25 625 | T2 | 4/2009 | |
| EP | 0 650 782 | B1 | 12/2000 | |
| EP | 1 681 111 | A1 | 7/2006 | |
| EP | 2 586 544 | A1 | 5/2013 | |
| EP | 2 707 159 | B1 | 6/2015 | |
| EP | 2 915 604 | A1 | 9/2015 | |
| EP | 2915604 | A1 * | 9/2015 | B21D 5/002 |
| JP | H0553723 | U | 7/1993 | |
| JP | 2009106972 | A | 5/2009 | |
| WO | 2008/011648 | A1 | 1/2008 | |

* cited by examiner

BACKGAUGE FOR A BENDING MACHINE AND METHOD FOR POSITIONING A BACKGAUGE OF THIS KIND

CROSS REFERENCE TO RELATED APPLICATIONS

This application is the National Stage of PCT/AT2017/060262 filed on Oct. 13, 2017, which claims priority under 35 U.S.C. § 119 of Austrian Application No. A 50921/2016 filed on Oct. 14, 2016, the disclosure of which is incorporated by reference. The international application under PCT article 21(2) was not published in English.

The invention relates to a back gauge for a back gauge positioning system of a bending machine, and to a method for positioning of the back gauge.

A back gauge for a sheet-metal bending machine is known from DE 3739949 C1, in which a stop finger is displaceable relative to a base unit. The stop finger can be blocked by means of a locking pin, which pin can be moved into a bore in a guide rail, which bore corresponds to the pin.

The back gauge known from DE 3739949 C1 has the disadvantage that during activation of the safety function of the stop finger, automatic operation of the stop finger is available only in restricted manner.

A back gauge is known from EP 2 915 604 A1, in which a stop finger is displaceable relative to a base unit if a predetermined force is exceeded and thereby a magnetic locking device is released.

The back gauge known from EP 2 915 604 A1 has the disadvantage that the predetermined force for releasing the magnetic locking device must be selected to be correspondingly low so as to guarantee that the safety function is maintained. The necessarily weak dimensioning of the magnetic locking device can, however, lead to the result that this device is released even unintentionally upon contact with sheet-metal workpieces.

It was the task of the present invention to overcome the disadvantages of the state of the art and to make available an apparatus and a method by means of which a back gauge can be positioned with increased safety, wherein the full functionality of the back gauge is supposed to be maintained.

This task is accomplished by means of an apparatus and a method according to the claims.

A back gauge for a back gauge positioning system of a bending machine is configured according to the invention. The back gauge comprises a stop finger on which at least one stop surface is configured, a base unit that is configured for coupling with the back gauge positioning system, wherein the stop finger is coupled with the base unit by means of a linear guide, and the stop finger can be displaced relative to the base unit between a pushed-forward working position and a retracted position. The stop finger and the base unit are coupled with a reset apparatus, in particular a first spring element, by means of which the stop finger is pre-loaded into its working position. Furthermore, a switchable locking device is configured, by means of which the stop finger can optionally be locked in the working position or is released into its retracted position for displacement, in particular counter to the spring force of the first spring element.

It is advantageous in the embodiment of the back gauge according to the invention that the stop finger is pre-loaded into its working position by means of the first spring element. Thereby the result can be achieved that the stop finger, after having been displaced out of its working position, is moved back into it as soon as an acting force that brings about the displacement has been removed again.

Furthermore, the stop finger can be optionally locked in its working position or released for displacement counter to the spring force of the first spring element, by means of the locking device. In particular, a stop mode can be implemented by means of the locking device, in which the stop finger is locked in its working position and thereby is configured for stopping sheet-metal workpieces to be bent. When the locking device is deactivated, the back gauge is in what is called a safety mode or displacement mode, in which the stop finger can be moved relative to the base unit, wherein only the spring force of the first spring element needs to be overcome. The spring force of the first spring element is selected to be correspondingly low, since the mass inertia of the stop finger acts on the impediment during a displacement movement of the back gauge, in addition to the spring force of the first spring element.

Furthermore, it can be practical if the locking device comprises a holding part, in particular an electromagnet, wherein the stop finger can be locked in place relative to the base unit by means of application of activation energy in the holding part. It is advantageous, in this regard, that an electromagnet can be easily activated and deactivated in an automated bending machine. Furthermore, electricity is present on every bending machine as an energy source for the electromagnet. As compared with a mechanical locking system, an electromagnet furthermore has the advantage that no mechanically displaceable components are provided, which are subject to wear and would have to be serviced. Therefore an electromagnet can have a longer useful lifetime.

Furthermore, it can be provided that the locking device has a mechanically acting locking unit. The stop finger can be fixed in place in its position relative to the base unit by means of the mechanically acting locking unit.

In a first exemplary embodiment, it can be provided, for example, that the mechanically acting locking unit of the locking device is configured for production of a shape-fit connection between the stop finger and the base unit. Such a shape-fit connection can be achieved, for example, by means of a shaped element that is disposed on the base unit and is pushed into a corresponding recess of the stop finger.

In particular, it can be provided that the shaped element has a wedge surface. Thereby the result can be achieved that the positioning accuracy of the back gauge unit can be increased, since the stop finger can be pressed into its working position by means of the wedge surface.

Alternatively, it can be provided that the shaped element can be configured, in particular, in the form of an alignment pin. Such an alignment pin can also have a conical shape, for example, so as to be able to achieve precise positioning of the stop finger.

The shaped element can be pushed into the recess of the stop finger by means of actuators having the most varied configurations. The actuators can be configured, for example, in the form of pneumatic or hydraulic cylinders, electrical linear or rotary drives, or electromagnets.

In an alternative variant, it can be provided that the mechanically acting locking unit comprises a clamping device and is produced not as a shape-fit connection but rather as a friction-fit connection.

Of course, it is also conceivable that the shape-fit connection can be produced by means of a micro-serration.

Furthermore, it can be provided that a second spring element is provided, which is coupled with the stop finger and the base unit with the interaction of the locking device, wherein when the locking device is locked, the stop finger is fixed in place in its working position by means of the second spring element. It is advantageous, in this regard, that the stop finger is not coupled with the base unit in completely rigid manner, but rather that the stop finger is pre-loaded into its working position also with the spring force of the second spring element, in addition to the spring force of the first element.

As a result, the stop finger can be pushed out of its working position counter to the effect of the two spring elements in the event of an overly great acting force. This allows protection of the overall back gauge unit. A further advantage is that force peaks caused by a greater impact of the sheet metal on the stop finger are partially absorbed by the spring. The second spring element can be interposed in all the different types of locking devices.

Furthermore, it can be provided that the second spring element has a greater spring rigidity than the first spring element and/or that the second spring element has a greater pre-load than the first spring element. It is advantageous, in this regard, that the stop finger is pre-loaded into its working position by only a slight exertion of force by means of the first spring element, and that in the case of selective addition of the second spring element, the pre-load of the stop finger into its working position can be increased by a multiple.

The first spring element can have a spring rigidity between 0.01 N/mm and 1 N/mm, in particular between 0.1 N/mm and 0.5 N/mm, preferably about 0.2 N/mm, for example. Furthermore, the first spring element can have a pre-load between 1 N and 15 N, in particular between 3 N and 10 N, preferably about 7 N.

The second spring element can have a spring rigidity between 0.1 N/mm and 30 N/mm, in particular between 1 N/mm and 10 N/mm, preferably about 2 N/mm, for example. Furthermore, the second spring element can have a pre-load between 20 N and 600 N, in particular between 160 N and 4500 N, preferably about 250 N to 300 N.

An embodiment according to which it can be provided that the holding part of the locking device is held on the base unit non-displaceably relative to the unit, in the main adjustment direction, and that the locking device has a counter-element that interacts with the holding part, which element is disposed on a guide rod, wherein the guide rod is mounted at least on a first mounting cheek, wherein the counter-element is disposed on an end region of the guide rod and the second spring element is disposed on the guide rod opposite to the counter-element, with reference to the first mounting cheek, is also advantageous.

Alternatively, it can also be provided that the electromagnet is held, relative to the base unit, so as to be non-displaceable on it, and that the locking device has a counter-element that interacts with the electromagnet, which element is disposed on a guide rod, wherein the guide rod is mounted on a first mounting cheek and on a second mounting check, which are disposed at a distance from one another, wherein the counter-element is disposed to lie closer to the first mounting cheek on an end region of the guide rod that lies outside of the two mounting cheeks, in accordance with a cantilevered mounting. By means of this structure of the back gauge, the functionality of the optionally lockable stop finger can be implemented in the most efficient manner possible, wherein the overall structure of the back stop is structured as simply as possible.

Furthermore, it can be practical if the guide rod is mounted in the first mounting cheek with mounting play, so that a slight angular rotation and/or radial displacement between the guide rod and the first mounting cheek is/are made possible.

Furthermore, it can be provided that the guide rod is additionally mounted on a second mounting cheek, wherein the first mounting cheek and the second mounting cheek are disposed at a distance from one another.

According to a further development, it is possible that a stop element for the second spring element is configured on the guide rod, wherein the second spring element is configured as a pressure spring and held on the guide rod between the first mounting cheek and the stop element, whereby the stop element is pre-loaded away from the first mounting cheek by means of the second spring element, and thereby the counter-element is pre-loaded toward the first mounting cheek. By means of this measure, the second spring element can be positioned in the back gauge in the simplest possible manner. Furthermore, the stop finger can be pre-loaded into its working position.

Furthermore, it can be provided that the holding part is configured as an electromagnet and that the counter-element is configured as a disk that interacts with the electromagnet, which disk is disposed on the guide rod on its end face, wherein the electromagnet and the counter-element lie against one another at contact surfaces. It is advantageous, in this regard, that such a connection can be switched with a very short switching time.

Furthermore, it can be provided that the electromagnet and/or the counter-element are held on an articulated mounting, so that the contact surfaces can be oriented parallel to one another. It is advantageous, in this regard, that by means of these measures, the air gap between the two contact surfaces can be reduced and thereby the holding force of the magnet can be increased.

In a further development, it can be provided that the articulated mounting comprises a universal joint or a ball-head joint. It is advantageous, in this regard, that such articulated mountings are easy to produce and furthermore demonstrate great stability.

Furthermore, it can be practical if a buffer element is provided, which serves for damping the stop finger when it is displaced into the retracted position. It is advantageous, in this regard, that the back gauge is protected by means of this measure.

Furthermore, it can be provided that the linear guide is configured in the form of a recirculating ball bearing guide. A recirculating ball bearing guide has the advantage that it moves as easily as possible and therefore the spring force of the first spring element can be selected to be as low as possible.

Furthermore, it can be provided that the linear guide comprises a guide carriage, which is coupled with the stop finger and comprises a guide rail that is coupled with the base unit.

According to a special embodiment, it is possible that the base unit has a base part that is coupled with the back gauge positioning system and has a lid part that is attached to the base part by attachment means. By means of this measure, the result can be achieved that the back gauge can be assembled easily or disassembled easily if maintenance is needed.

In accordance with an advantageous further development, it can be provided that the two mounting cheeks are attached to the lid part. It is advantageous, in this regard, that the mounting cheeks are easily accessible as the result of this measure.

In particular, it can be advantageous if the guide rail is attached to the lid part.

Furthermore, it can be provided that two of the second spring elements are disposed parallel to one another. This brings with it the advantage that the pre-load of the stop finger into its working position can be increased, wherein the individual second spring elements do not need to have an excessively great spring rigidity, but rather the spring rigidity of the two second spring elements is added up. As a result, weight can be saved.

Furthermore, it can be provided that a force sensor is provided, which is configured for capturing the amount of an acting force. By means of this measure, the stop force of a sheet-metal workpiece to be stopped can be captured. As a result, it is possible to signal to the machine operator when the sheet-metal workpiece lies against the stop finger with a predefined stop force and thereby correct positioning of the sheet-metal workpiece has been achieved.

An embodiment according to which it is provided that the first mounting cheek of the stop surface is disposed to lie closer than the second mounting cheek is also advantageous.

According to a further development, it is possible that at least one display element for display of the status of the locking device is disposed on the stop finger. It is advantageous, in this regard, that the status of the locking device can be displayed to the machine operator by the display element, and as a result, the machine operator is notified whether the bending machine is ready for contact of the sheet-metal workpiece to be bent.

Furthermore, it can be practical if a sensor element is provided, which serves for capture of a relative movement and/or relative position between the stop finger and the base unit. It is advantageous, in this regard, that by means of this measure, displacement of the stop finger relative to the base unit can be detected, and thereby a displacement movement of the back gauge can be stopped in timely manner.

Furthermore, it can be provided that the sensor element is configured in the form of an inductive sensor. An inductive sensor, in particular, has great capture accuracy and a short capture time.

According to the invention, a method for positioning of the back gauge by means of a back gauge positioning system of a bending machine is provided. The method comprises the following method steps:

- setting of a displacement mode of the back gauge, wherein the locking device is not locked and wherein the stop finger is pre-loaded into its working position by means of a reset apparatus, in particular a first spring element;
- displacement of the back gauge by means of the back gauge positioning system into its predetermined stop position;
- locking of the stop finger in its working position by means of the locking device.

It is an advantage of the method according to the invention that during positioning of the back gauge, what is called a displacement mode or safety mode can be set, in which the stop finger is displaceable relative to the base unit. As a result, the stop finger can move relative to the base unit if it touches an impediment, such as the hand of a machine operator, so as not to injure the machine operator. The displacement path is selected, in particular, so as to be great enough that in the event of detection of contact of the stop finger on the impediment, the displacement movement of the back gauge can be stopped within this displacement path.

According to a special embodiment, it is possible that the relative movement and/or relative position between the stop finger and the base unit is monitored during the displacement mode of the back gauge, by means of the sensor element, and if a relative movement between the stop finger and the base unit is captured during the displacement of the back gauge, the displacement movement is abruptly stopped. It is advantageous, in this regard, that by means of this measure, the required displacement path of the stop finger relative to the base unit can be kept as low as possible.

For a better understanding of the invention, it will be explained in greater detail using the following figures.

Figure 2:
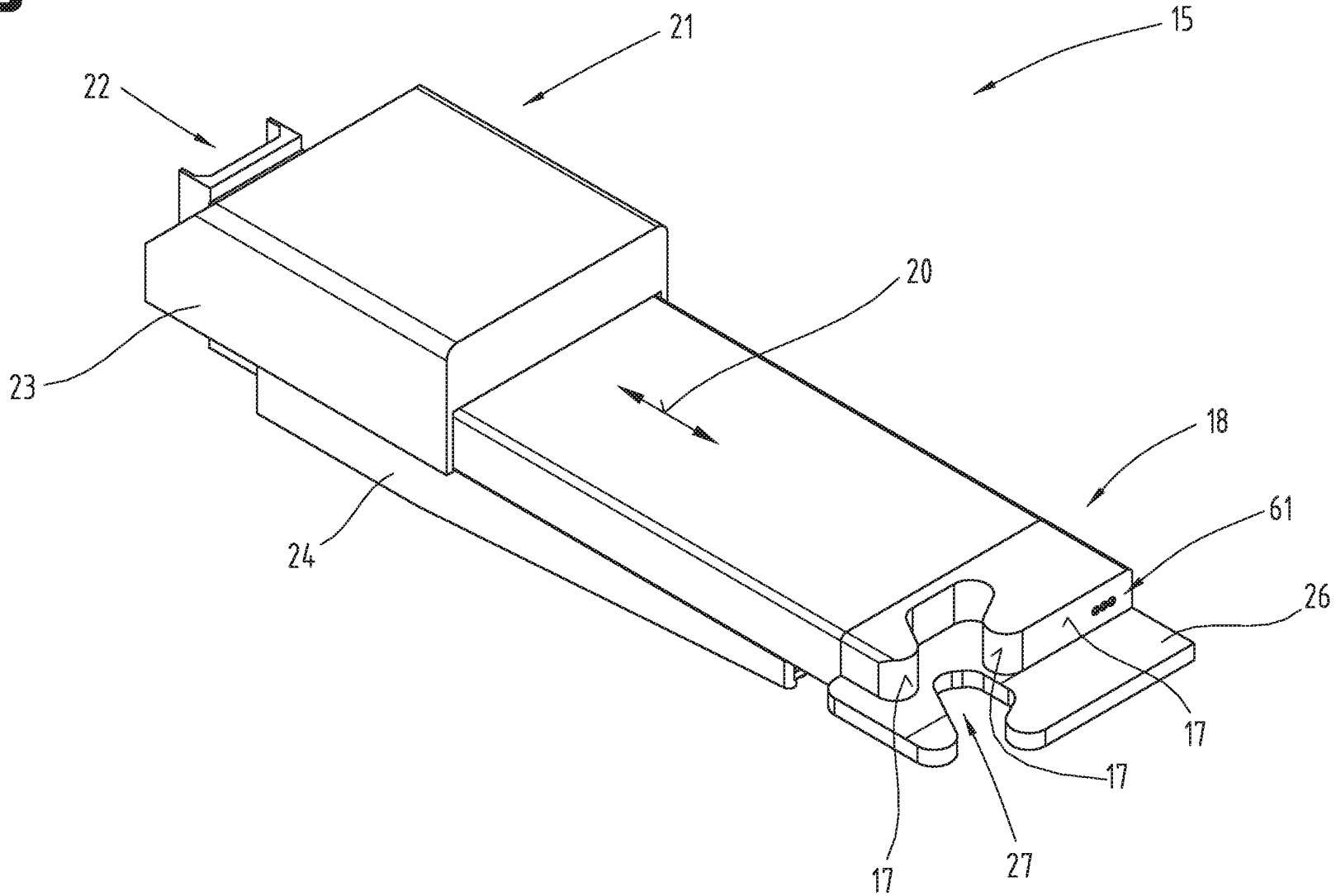
Figure 3:
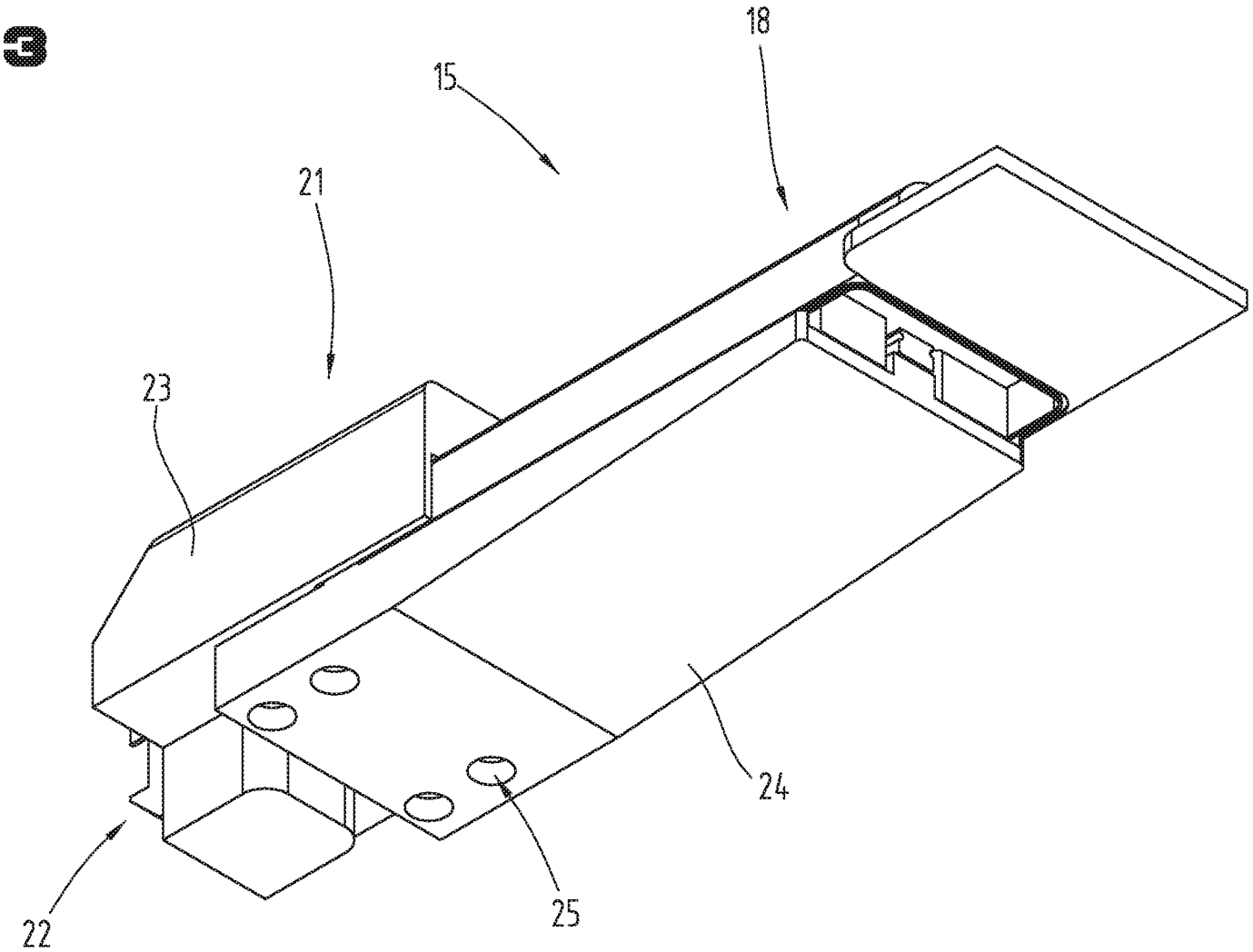
Figure 4:
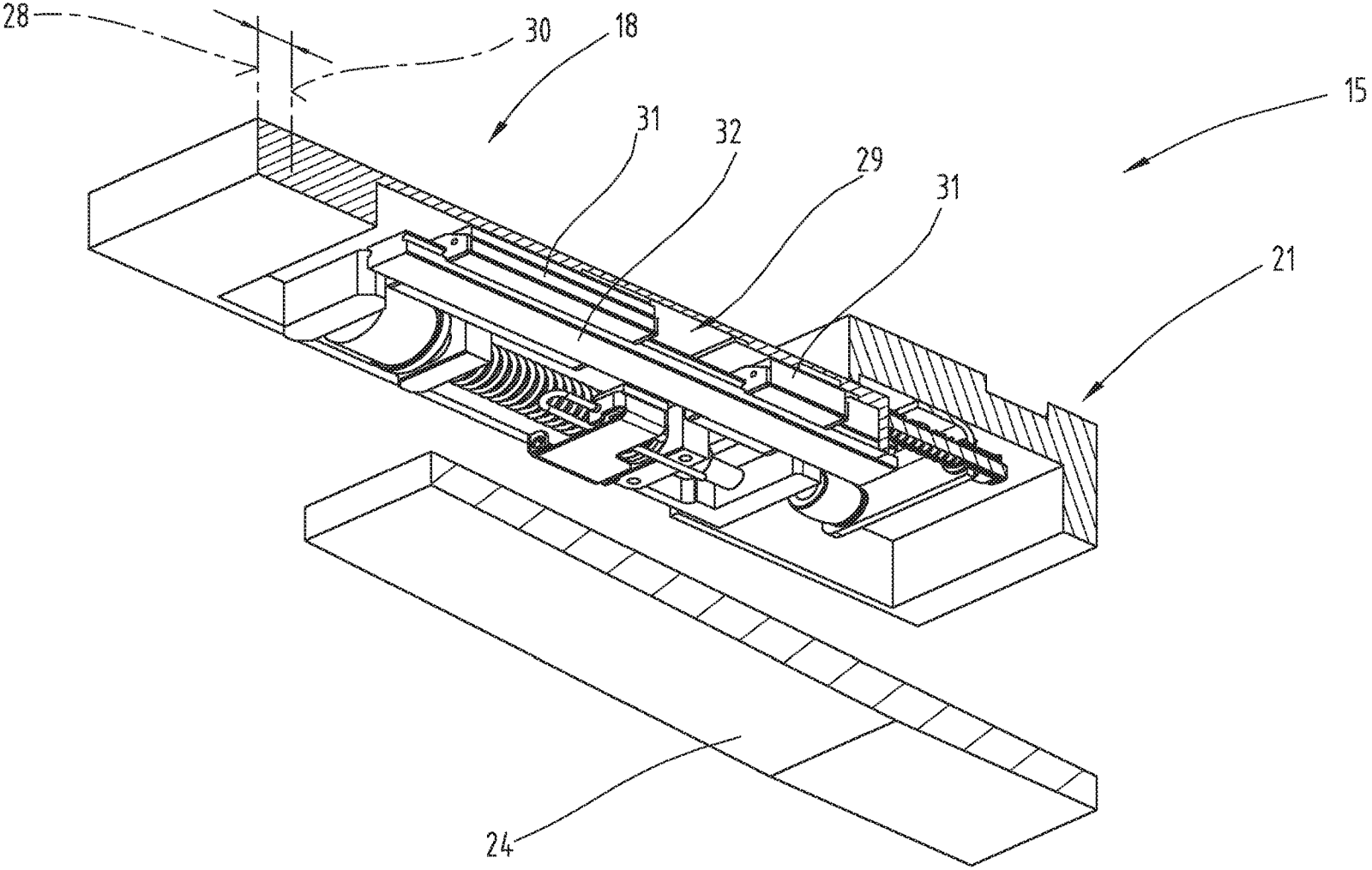
Figure 5:
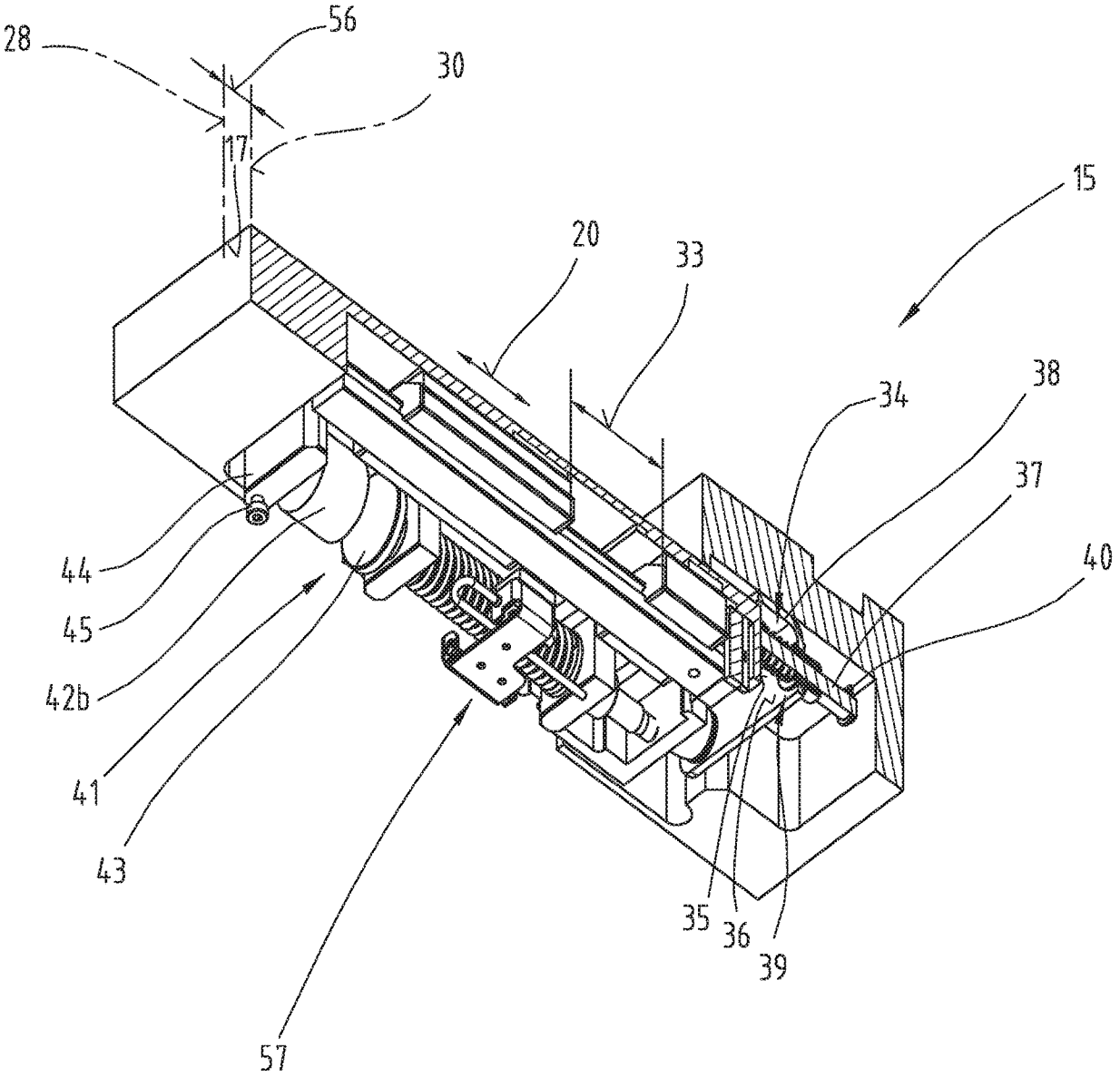
Figure 6:
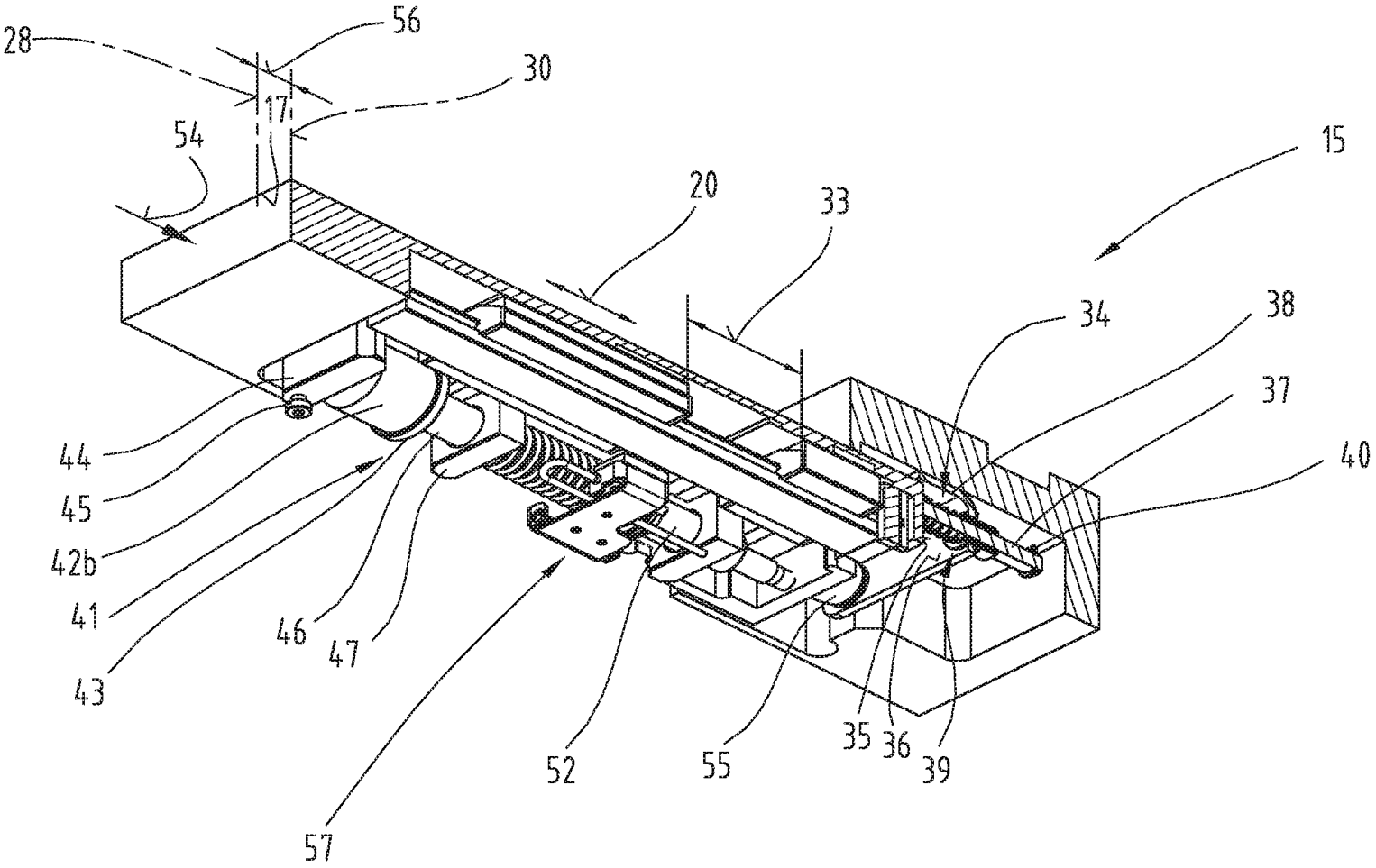
Figure 7:
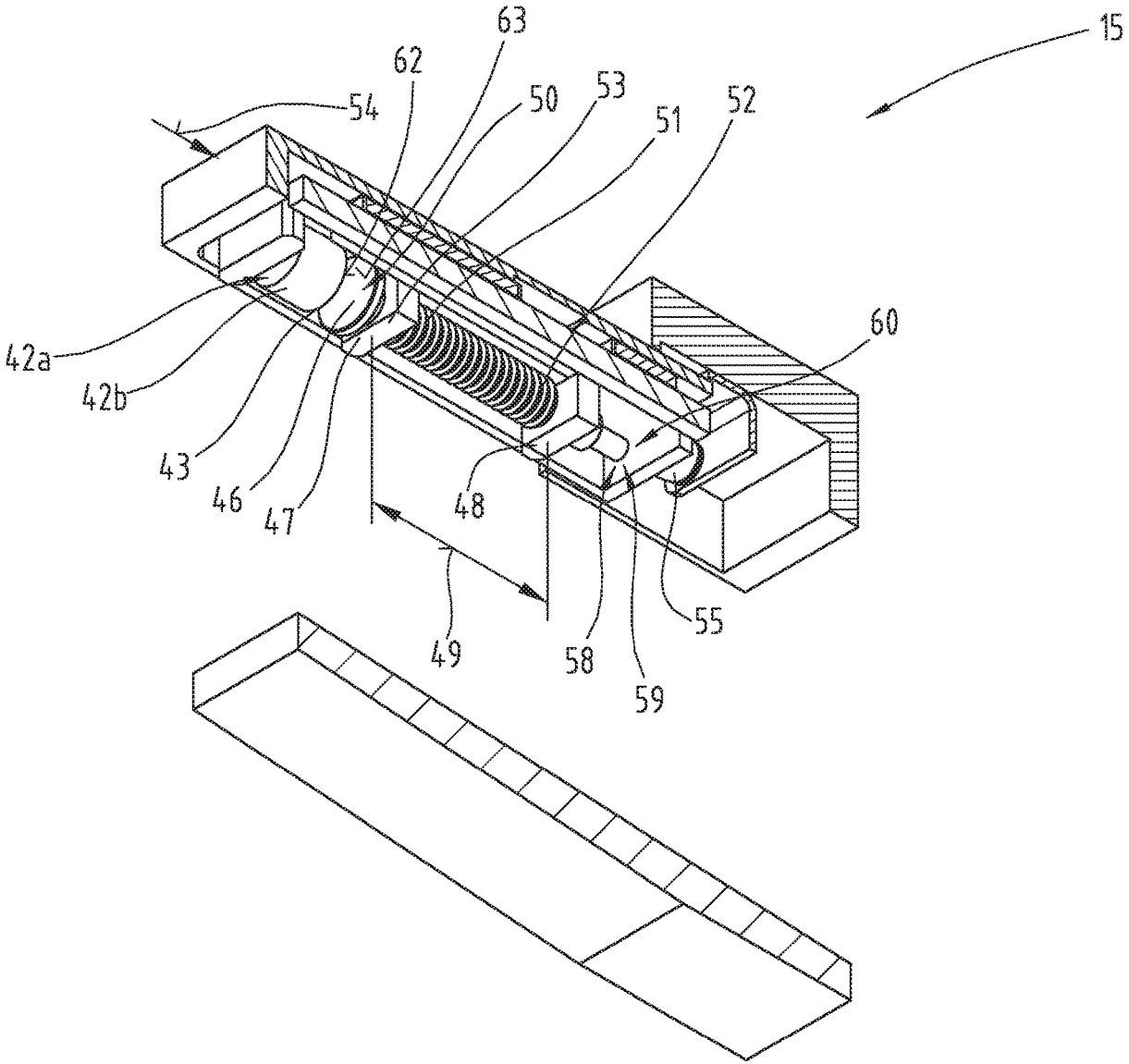
Figure 8:
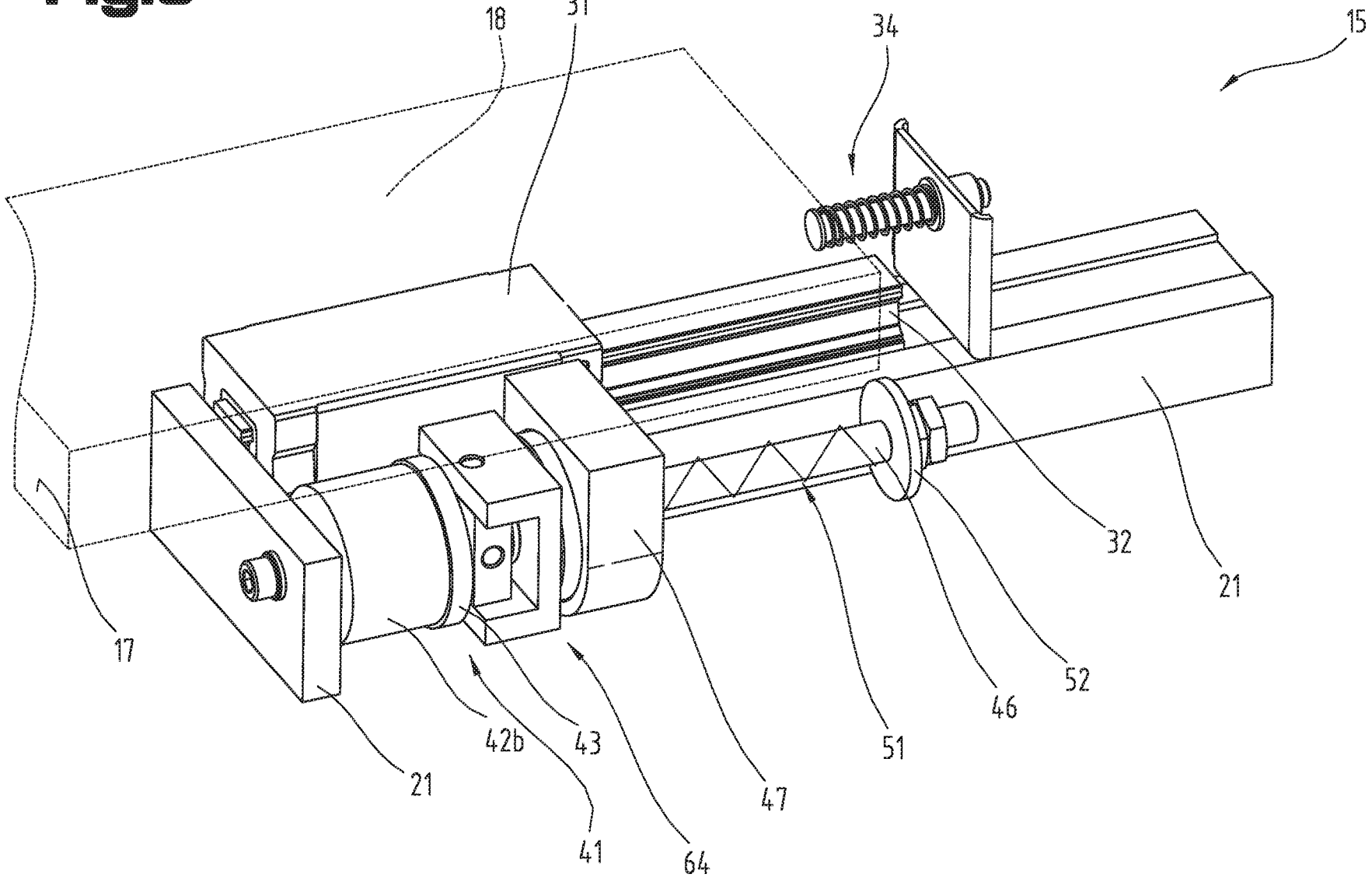
Figure 9:
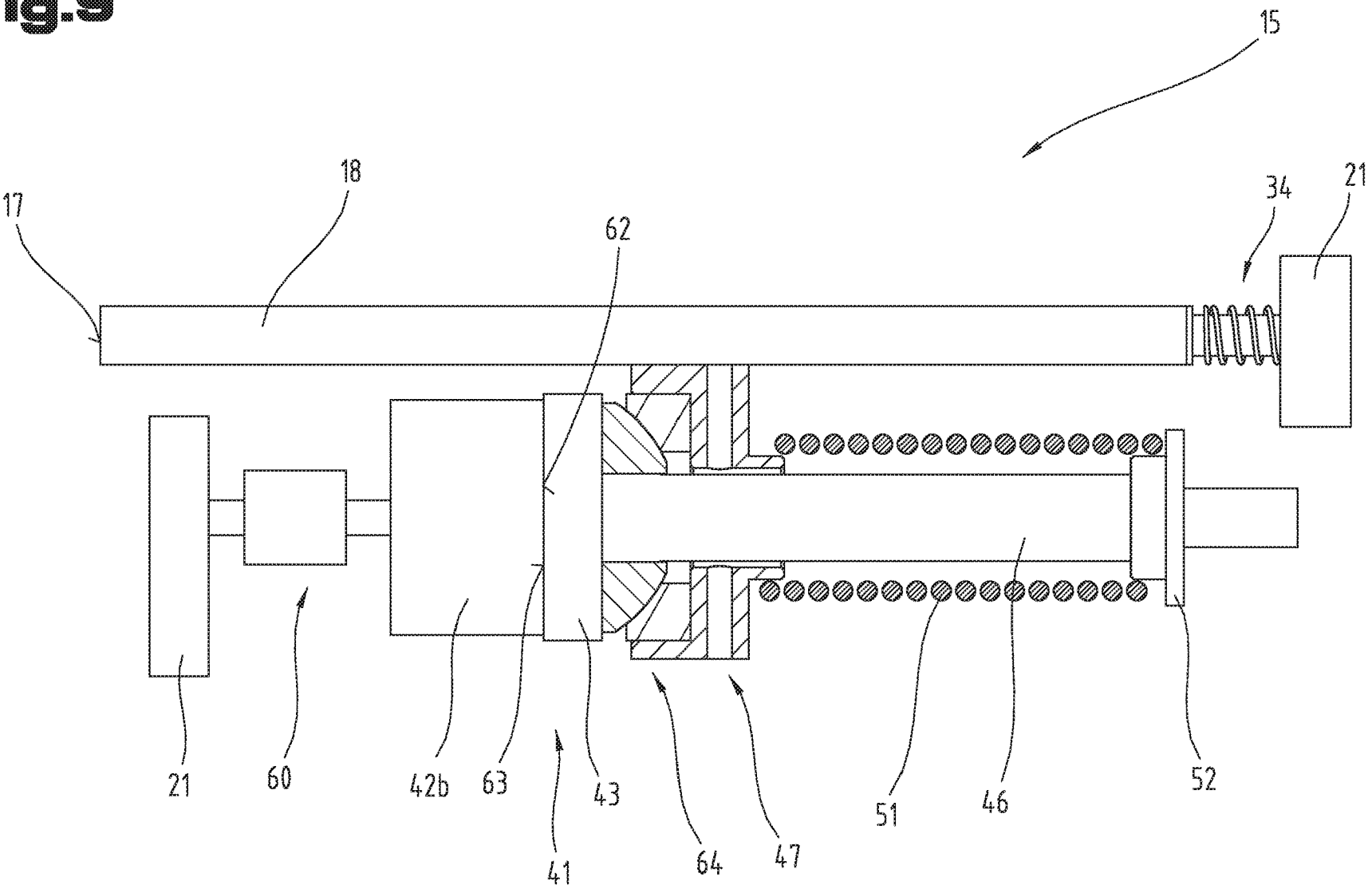
Figure 10:
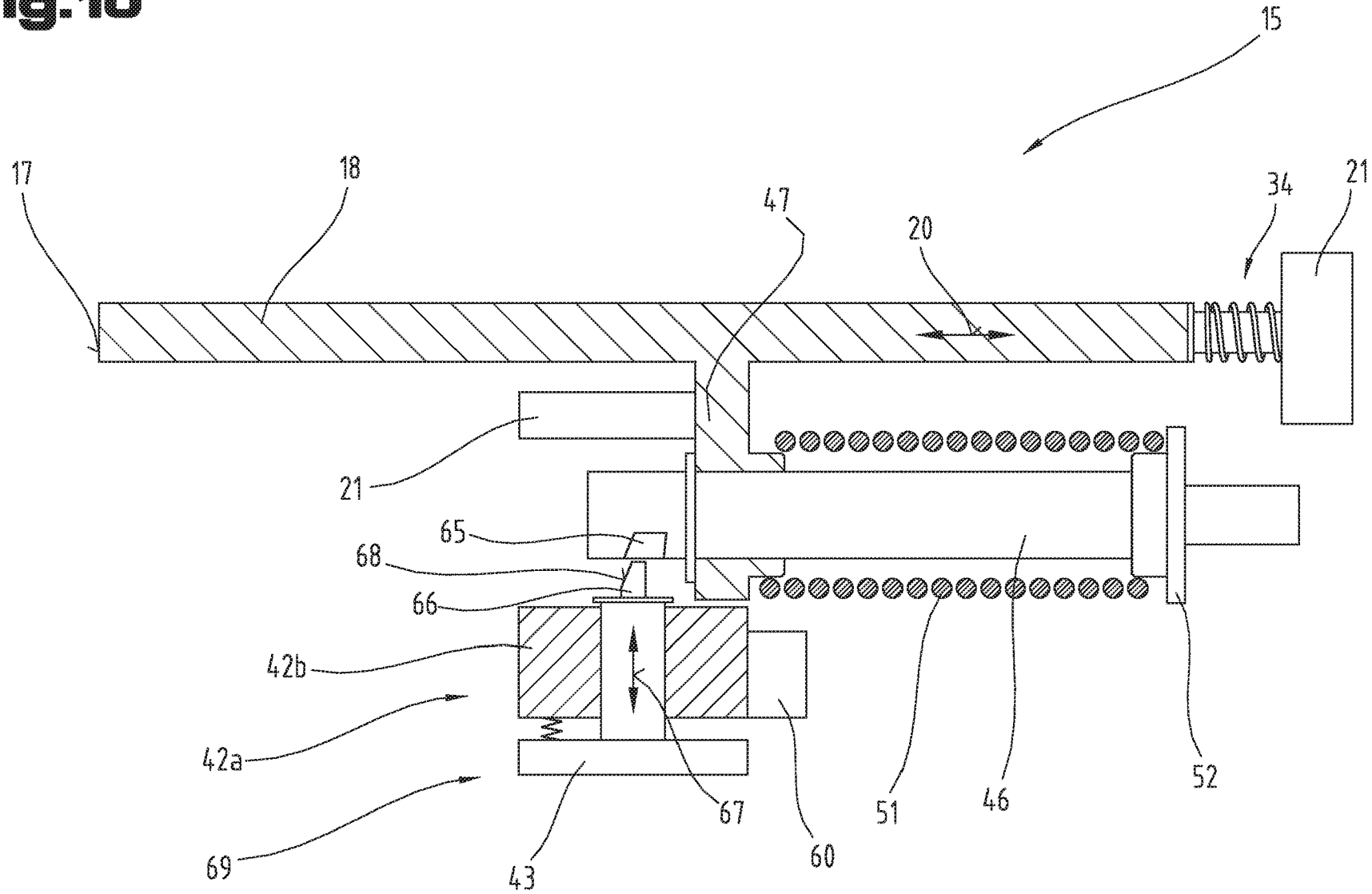
Figure 11:
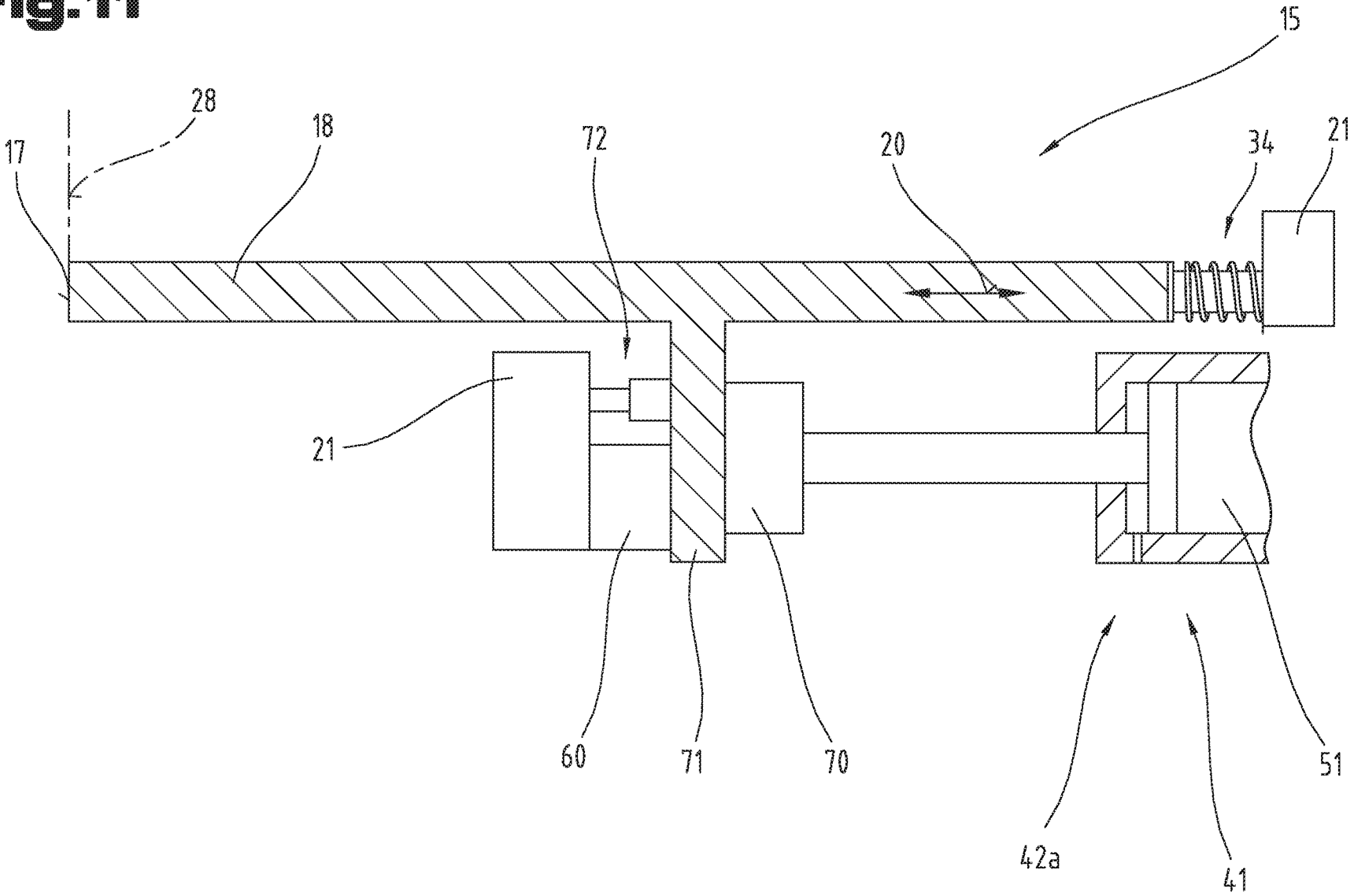

These show, each in a greatly simplified, schematic representation:

FIG. 1 a perspective representation of an exemplary embodiment of a bending machine;

FIG. 2 a perspective representation of an exemplary embodiment of a back gauge in a view at a slant from above;

FIG. 3 a perspective representation of an exemplary embodiment of a back gauge in a view at a slant from below;

FIG. 4 a sectional representation of the back gauge in a first section plane, wherein the stop finger is situated in the working position;

FIG. 5 a sectional representation of the back gauge in the first section plane, wherein the stop finger is situated in the retracted position and the locking device is not activated;

FIG. 6 a sectional representation of the back gauge in the first section plane, wherein the stop finger is situated in the retracted position and the locking device is activated;

FIG. 7 a sectional representation of the back gauge in a second section plane, wherein the stop finger is situated in the retracted position and the locking device is not activated;

FIG. 8 a perspective representation of a further exemplary embodiment of the back gauge with only a first mounting cheek;

FIG. 9 a schematic sectional representation of a further exemplary embodiment of the back gauge with only a first mounting cheek and a guide rod that is equipped with a ball joint;

FIG. 10 a schematic sectional representation of a further exemplary embodiment of the back gauge with a holding element that engages with shape fit;

FIG. 11 a schematic sectional representation of a further exemplary embodiment of the back gauge with a holding element in the form of a pneumatic cylinder.

As an introduction, it should be stated that in the different embodiments described, the same parts are provided with the same reference symbols or the same component designations, wherein disclosures contained in the description as a whole can be applied analogously to the same parts having the same reference symbols or component designations. Also, the position information selected in the description, such as at the top, at the bottom, at the side, etc., for example, relates only to the figure being directly described and shown, and this position information must be applied analogously to a new position in the case of a change in position.

In the following, a workpiece processing machine and a method for operation of a workpiece processing machine using a bending machine or press brake is described in detail as an exemplary embodiment. At this point, it should be noted that the following information can, of course, be transferred also to other types of workpiece processing machines in which automatically controlled stop apparatuses having stop fingers for positioning of workpieces are used, and that a person skilled in the art of the technical field can apply the teaching that can be derived from the following description to other types of workpiece processing machines, as well.

In FIG. 1, an exemplary embodiment of a workpiece processing machine 1 in the form of a bending machine 2, in particular a press brake 3, is shown. The workpiece processing machine 1 or press brake 3 is intended for processing a workpiece 4, in particular bending it. The press brake 3 has a fixed table beam 6 that is oriented perpendicular to a contact surface 5. For processing of workpieces 4, the bending machine 2 or the press brake 3 shown comprises a press beam 7, which can be adjusted or displaced relative to the table beam 6, in the vertical direction, by a drive means 8, for example a hydraulic cylinder 9.

Processing or forming of a workpiece 4 is brought about, in the case of the press brake 3 according to the exemplary embodiment shown in FIG. 1, by means of a lower bending tool 10 and an upper bending tool 11. In this regard, the lower bending tool 10, for example what is called a bending die can be disposed in a lower tool holder 12 of the table beam 6. An upper bending tool 11 or what is called a bending punch can be disposed in an upper tool holder 13 of the press beam 7.

Usually, in this regard the bending tools 10, 11 are disposed or held in the tool holders 12, 13 interchangeably, so that suitable bending tools 10, 11 can be chosen or used for respective processing or forming of a workpiece 4, in each instance. Of course, it is also possible that multiple lower bending tools 10 and upper bending tools 11 are disposed in the region of the press brake 3 in the tool holders, in each instance, during operation of the press brake 3, for example so as to be able to undertake different bending processes on a workpiece 4 during forming or bending operations that take place one after the other. For reasons of clarity, only one lower bending tool 10 and one upper bending tool 11 are shown in the exemplary embodiment according to FIG. 1, in each instance.

In the press brake 3 shown as an exemplary embodiment in FIG. 1, furthermore at least one automatically controlled back gauge positioning system 14 having at least one back gauge 15 for positioning of the workpiece 4 is shown. The back gauge 15 is shown only schematically and will still be described and shown in greater detail in the further figures.

In the exemplary embodiment shown, two back gauge positioning systems 14, each having a back gauge 15, are shown as an example.

The back gauge positioning systems 14 and back gauges 15 shown in FIG. 1 are disposed in a free space on a rear side of the table beam 6 of the bending machine 2. The back gauge or gauges 15 can each be adjusted or displaced into a stop position 16 intended for positioning of a workpiece 4. When a back gauge 15 is adjusted into a stop position 16, a workpiece 4 to be processed can then be laid against a stop surface 17 of a stop finger 18 of the back gauge 15 from a front side or workpiece feed side of the workpiece processing machine that faces away from the press space. As a result, the workpiece 4 can be positioned in a desired position between the two bending tools 10, 11, so as to be able to carry out a bending process at a desired position.

The stop fingers 18 shown as an example in FIG. 1 have only one stop surface 17. Fundamentally, embodiment variants of stop fingers 18 can also comprise more than one stop surface 17, as well as additional support surfaces for workpieces 4.

The back gauge positioning systems 14 or back gauges 15 shown in FIG. 1 are usually adjusted or displaced by means of drive arrangements, not shown in any greater detail. The drive arrangements can comprise guide tracks as well as actuators such as electric motors, for example, in particular servo motors, and are driven automatically.

A control apparatus 19 can be provided to control the displacement or adjustment movements of the back gauge positioning system 14 or of the back gauge 15. As indicated in FIG. 1, the control apparatus 19 can have multiple components, for example multiple processors or computer components, input means for input of control commands, output means for display of information, etc. Furthermore, it is also possible that the control apparatus 19 is connected with further control components, for example with mobile input and output means, by way of a network or by way of the Internet.

In the case of bending machines 2, adjustment or automated displacement of the back gauges 15 can be provided along at least one main adjustment direction 20. Furthermore, the back gauges 15 can also be adjusted in the longitudinal direction of the bending machine 2 or with regard to its height, in automated manner.

Fundamentally, a risk of collisions of the stop finger 18 with other objects, for example a hand of an operator, exists in the case of automatically controlled displacement or adjustment movements of the back gauge positioning system 14 or of the back gauge 15. For this reason, the back gauge 15 is equipped with a safety function, so as to protect the operator, as will still be described in greater detail in the further figures.

In FIGS. 2 and 3, the back gauge 15 is shown in a perspective view at a slant from above and at a slant from below, respectively. In FIGS. 4 to 6, the back gauge 15 is shown in section, in a first section plane, wherein different positions of the back gauge 15 are shown. In FIGS. 7 and 8, the back gauge 15 is shown in further sectional representations.

For the same parts, the same reference symbols or component designations are used as in the preceding figures, in each instance. In order to avoid unnecessary repetition, reference is always made to the detailed description in the preceding figures, or this is pointed out, wherein the following description is based on the representation in FIGS. 2 to 8.

The back gauge 15 has a stop finger 18 and a base unit 21. The stop finger 18 is held on the base unit 21 so as to be displaceable in the main adjustment direction 20 relative to the latter. The base unit 21 has a coupling apparatus 22, by means of which the back gauge 15 is attached to the back gauge positioning system 14.

As is evident from FIGS. 2 and 3, it can be provided that the base unit 21 has a basic part 23, on which a lid part 24 is disposed. The coupling apparatus 22 is preferably disposed on the basic part 23 of the basic base unit 21. The lid part 24 can be disposed on the basic part 23 of the base unit 21 by attachment means 25, in particular screws.

As is furthermore evident from FIGS. 2 and 3, it can be provided that the stop finger 18 has an interchangeable finger tip 26, on which the stop surface 17 is configured. The stop surface 17 is preferably disposed at a right angle to the main adjustment direction 20. Furthermore, it can also be provided that diverse recesses 27 are configured, which also have a stop surface 17.

In FIG. 4-6, the back gauge unit 15 is shown in different positions, wherein a sectional representation having the same section plane was selected in all three FIGS. 4-6. In the sectional representation, the lid part 24 was furthermore shown in an exploded view, so as to be better able to show and describe the function of the back gauge 15. The following description is based on looking at FIGS. 4-6 together.

In the representation according to FIG. 4, the stop finger 18 is in its pushed-forward working position 28, which can also be referred to as a basic position. As is evident from FIG. 4, a linear guide 29 is configured, by means of which the stop finger 18 is displaceably held on the base unit 21. The stop finger 18 can be displaced between the pushed-forward working position 28 and a retracted position 30, in which it is pushed backward, by means of the linear guide 29. The linear guide 29 is configured in such a manner that the stop finger 18 can be pushed, relative to the base unit 21, between the working position 28 and the retracted position 30 in the main adjustment direction 20.

Preferably, the linear guide 29 comprises a guide carriage 31, which is held on a guide rail 32 so that it can be pushed in the main adjustment direction 20.

The guide carriage 31 can be mounted on the guide rail 32 by means of a recirculating ball bearing mounting.

Alternatively to this, it is also conceivable that a slide bearing, such as a swallowtail guide, for example, is provided between the guide carriage 31 and the guide rail 32.

As is furthermore evident from FIG. 4, it can be provided that two of the guide carriages 31 are provided and disposed at a distance 33 from one another. The embodiment of two guide carriages 31 brings with it the advantage that the stop finger 18 can be put under stress with an increased force, in particular an increased bending stress.

Furthermore, a first spring element 34 is provided, by means of which the stop finger 18 is pre-loaded into its working position 28. The first spring element 34 is configured, in particular, as a pressure spring, and is disposed between an end face 35 of the stop finger 18 and an end face 36 of the base unit 21. Instead of the first spring element 34, a further reset apparatus, such as a pneumatic cylinder, a gas spring, an electrical linear drive, and the like, for example, can also be provided.

Furthermore, it can be provided that a guide bolt 37 can be configured, on which the first spring element 34 is held. The guide bolt 37 can be rigidly coupled with the stop finger 18, or can be held on it. Furthermore, it can be provided that a stop strip 38 is provided on the base unit 21, on which the end face 36 for making contact with the first spring element 34 is configured.

A conduit 39 can be configured on the stop strip 38, through which the guide bolt 37 is passed. A locking ring 40, in particular an axial locking ring, can be disposed on the guide bolt 37 on the side opposite the first spring element 34 on the side of the stop strip 38. The stop finger 18 can be held in its working position 28 by means of the locking ring 40, wherein the locking ring 40 lies against the stop strip 38 in the working position 28 of the stop finger 18.

Furthermore, a locking device 41 is provided, by means of which the stop finger 18 can be fixed in place in its working position 28. The locking device 41 can comprise a holding part 42*a* that interacts with a counter-element 43. In the present exemplary embodiment, it can be provided that the holding part 42*a* is configured in the form of an electromagnet 42*b*.

In particular, it can be provided that the electromagnet 42*b* is held on a magnet holder 44. The magnet holder 44 can be coupled with the lid part 24 of the base unit 21 by attachment means 45, in particular screws. Stated in different words, it can be provided that the electromagnet 42*b* is rigidly held on the base unit 21, i.e. in non-displaceable manner.

The counter-element 43, in contrast, is movement-coupled with the stop finger 18. In particular, it can be provided that the counter-element 43 is configured in the form of a magnet that interacts with the electromagnet 42*b*.

Furthermore, it can be provided that the counter-element 43 is held on a guide rod 46, wherein the guide rod 46 is held on a first mounting cheek 47 and on a second mounting cheek 48 so as to be displaceable in the main adjustment direction 20. The first mounting cheek 47 and the second mounting cheek 48 are disposed at a distance 49 from one another and attached to the stop finger 18.

The counter-element 43 is preferably disposed on an end region 50 of the guide rod 46. The end region 50 of the guide rod 46 projects freely relative to the first mounting cheek 47.

Furthermore, it can be provided that a second spring element 51 is disposed on the guide rod 46, between the first mounting cheek 47 and the second mounting cheek 48. The second spring element 51 can be configured, in particular, as a pressure spring, and can lie against the first mounting cheek 47 as well as against a stop element 52, which is disposed on the guide rod 46. The stop element 52, which is disposed between the first mounting cheek 47 and the second mounting cheek 48, is pressed in the direction toward the second mounting cheek 48 by means of the spring force of the second spring element 51. As a result, the counter-element 43 is also pressed in the direction toward the second mounting cheek 48 or toward the first mounting cheek 47. Stated in different words, both the first mounting cheek 47 and the second mounting cheek 48, which are coupled with the stop finger 18 by means of attachment means 53, are pressed toward the counter-element 43 by the second spring element 51.

If the electromagnet 42*b* now has current applied to it and thereby develops its magnetic force, and the counter-element 43 adheres to the electromagnet 42*b*, then the stop finger 18 is pre-loaded into the working position 28 with the force of the second spring element 51 and with the force of the first spring element 34, i.e. pressed into this position.

If an acting force 54, applied by the workpiece 4, now acts on the stop surface 17, and the electromagnet 42*b* is activated, then the second spring element 51 and the first spring element 34 act to counter the acting force 54. If the spring force of the two spring elements is less than the acting force 54, then the stop finger 18, together with the mounting cheeks 47, 48 disposed on it, is pressed in the direction of the retracted position 30 and thereby displaced relative to the guide rod 46, since the counter-element 43 adheres to the electromagnet 42*b*.

Such a displaced position is shown in FIG. 6. This displacement occurs if the acting force 54 is greater than a maximally permissible acting force, by which the back gauge 15 would be damaged. Due to the possibility of displacement of the stop finger 18 counter to the force of the second spring element 51, force peaks that occur as the result of impacts when large workpieces 4 make contact can be absorbed.

Furthermore, it can be provided that a buffer element 55 is configured, which element is disposed between the stop finger 18 and the stop strip 38 and is configured for buffering of an impact.

When the electromagnet 42*b* is deactivated, the counter-element 43 does not adhere to the electromagnet 42*b* and therefore the second spring element 51 no longer acts counter to displacement of the stop finger 18 if, in this state, the acting force 54, for example caused by the hand of a machine operator, is greater than the low spring force of the first spring element 34, and therefore the stop finger 18 can be displaced relative to the base unit 21, as shown in FIG. 5.

If the acting force 54 is now taken away again, the stop finger 18 is shifted back into its working position 28 as the result of the spring force of the first spring element 34. A displacement path 56 of the stop finger 18, between the working position 28 and the retracted position 30, is preferably selected to be so great that at a predetermined displacement speed of the back gauge 15 in the main adjustment direction 20 and impact of the stop finger 18 against an impediment, sufficient displacement path remains so as to brake the back gauge positioning system 14 with a maximally permissible acceleration.

Furthermore, it can be provided that a sensor element 57 is disposed on the back gauge 15, by means of which sensor a relative movement between the stop finger 18 and the base unit 21 or a relative position between the stop finger 18 and the base unit 21 can be captured. A collision with an object can be signaled to the control apparatus 19 by means of the sensor element 57.

From FIG. 7, it is evident that the guide rail 32 of the linear guide 29 is coupled with the lid part 24 of the base unit 21.

From FIG. 8, it is evident that it can be provided that two of the second spring elements 51 are provided in the back gauge 15.

Furthermore, it can be provided that a force sensor 60 is disposed between a second end region 58 of the guide rod 46 and a rear wall 59 of the stop finger 18, which sensor is configured for capture of the pre-load force of the second spring element 51. When the electromagnet 42*b* is activated and the counter-element 43 adheres to the electromagnet 42*b*, then the force measured at the force sensor 60 amounts to the force of the second spring element 51 minus the acting force 54 reduced by the force of the first spring element 34.

If the acting force 54 is now the same as the spring force of the first spring element 34 and of the second spring element 51, then a force having the value of zero will be measured at the force sensor 60. If the acting force 54 is increased further, then the guide rod 46 will lift off the force sensor 60 completely, and the force of zero will continue to be measured at the force sensor 60.

A display element 61 is configured at the stop finger 18, in particular at the stop surface 17, by means of which element activation of the locking device 41 can be displayed. The display element 61 can be configured in the form of LED displays, for example. Furthermore, it can be provided that the acting force 54 is determined by means of the force sensor 60, and when the acting force 54 is reached in a predetermined force range, this is also displayed on the display element 61.

In a special bending mode for bending particularly thin or particularly large workpieces 4, it can be provided that the back gauge 15 is configured for fetching the workpiece 4. This can be implemented, in particular, in that for laying the workpiece 4 in place, the back gauge 15 is moved forward as far as possible toward the table beam 6. Subsequently, the workpiece 4 is laid onto the back gauge 15 and pressed against the stop surface 17. The acting force 54 on the stop surface 17 is captured by means of the force sensor, and subsequently, the back gauge 15 is pushed away from the table beam 6 into its stop position 16, wherein the workpiece 4 constantly lies on the back gauge, and thereby excessive sagging of the workpiece 4 is prevented.

FIG. 8, in a perspective view, shows a further possible structure of the back gauge 15, wherein once again, the same reference symbols or component designations are used for the same parts, as in the preceding FIGS. 1 to 7. In order to avoid unnecessary repetition, reference is made to the detailed description in the preceding FIGS. 1 to 7, i.e. this is pointed out.

As is evident from FIG. 8, it can be provided that the guide rail 32 is disposed on the base unit 21 of the back gauge 15, and that the stop finger 18 is held on the base unit 21, so as to be displaceable relative to the latter, by means of the guide carriage 31. Furthermore, the first spring element 34, which pre-loads the stop finger 18 into its working position 28, is shown schematically. Furthermore, the first mounting cheek 47 is coupled with the stop finger 18 and is displaceable along with it. The guide rod 46 is held in the first mounting cheek 47, which rod is displaceable relative to the first mounting cheek 47.

The stop element 52 is configured at an end section of the guide rod 46. The second spring element 51 is held or pre-loaded between the first mounting cheek 47 and the stop element 52. The stop element 52 is pressed away from the first mounting cheek 47 by means of the second spring element 51. The counter-element 43 is coupled with the guide rod 46 on the side of the first mounting cheek 47 that lies opposite the stop element 52. The counter-element 43 interacts with the electromagnet 42*b*, which is coupled with the base unit 21.

As is evident from FIG. 8, it can be provided that in the state of the back gauge 15 in which it is fixed in place, a contact surface 62 of the electromagnet 42*b* interacts with a contact surface 63 of the counter-element 43. In order to achieve the result that the two contact surfaces 62, 63 lie on one another as fully as possible, it can be provided that the counter-element 43 is coupled with the guide rod 46 by way of an articulated mounting 64. In this way, the two contact surfaces 62, 63 can be oriented parallel to one another. As is evident from FIG. 8, it can be provided that the articulated mounting 64 is configured in the form of a universal joint.

A universal joint or articulated mounting 64 configured in this manner can, of course, be used not just for holding the counter-element 43, but rather it is also possible that the articulated mounting 64 is configured for holding the electromagnet 42*b* and is disposed between the electromagnet 42*b* and the base unit 21. However, such an embodiment of the back gauge 15 is not specifically shown.

FIG. 9 shows a schematic representation of a further exemplary embodiment of the back gauge 15, wherein once again, the same reference symbols or component designations are used for the same parts as in the preceding FIGS. 1 to 8. In order to avoid unnecessary repetition, reference is made to the detailed description in the preceding FIGS. 1 to 8, i.e. this is pointed out.

As is evident from FIG. 9, it can be provided that the counter-element 43 is rigidly coupled with the guide rod 46, and that the complete guide rod 46, together with the counter-element 43, is held in the first mounting cheek 47 in a manner so as to pivot slightly. For this purpose, the mounting location between the first mounting cheek 47 and the guide rod 46 is structured in the form of a mounting with play, so that slight pivoting about an angle or slight radial displacement between the guide rod 46 and the first mounting cheek 47 can be balanced out. For centering of the guide rod 46 between the counter-element 43 and the first mounting cheek 47, the articulated mounting 64 is configured in the form of a ball head. As a result, the contact surface 63 of the counter-element 43 can be adapted to the contact surface 62 of the electromagnet 42*b*.

When the locking device 41 is activated, the counter-element 43 is held in place on the electromagnet 42*b*, and the first mounting cheek 47, together with the stop finger 18, is pushed toward the guide rod 46, and thereby the second spring element 51 is compressed.

To capture the acting force 50 that is applied to the stop surface 17, it can furthermore be provided that the power force sensor 60 between the electromagnet 42*b* and the base unit 21 is configured in the form of a tensile force measurement unit.

FIG. 10 shows a further exemplary embodiment of the back gauge unit 15, wherein once again, the same reference symbols or component designations are used for the same parts as in the preceding FIGS. 1 to 9. In order to avoid unnecessary repetition, reference is made to the detailed description in the preceding FIGS. 1 to 9, i.e. this is pointed out.

As is evident from FIG. 10, it can furthermore be provided that the locking device 41 is configured for locking of the guide rod 46 by means of a shape-fit connection. In particular, it can be provided that a notch 65 is disposed in the guide rod 46, by means of which notch a shaped element 66 interacts, wherein the shaped element 66 is configured for being pushed into the notch 65. The shaped element 66 is pushed into the notch 65 in the locking direction 67, and thereby the guide rod 46 is locked in place.

The stop finger 18 is positioned into its working position 28 in that an end stop is configured on the base unit 21, and the stop finger 18 is pressed against this end stop by means of the first spring element 34.

Furthermore, it can be practical if the shaped element 66 has a wedge surface 68. In this way, it can be ensured that the guide rod 46 can be locked in place in the working position 28 of the stop finger 18.

As shown schematically in FIG. 10, a setting apparatus 69 is provided, by means of which the shaped element 66 can be pushed in the locking direction 67. The locking direction 67 is configured transversely to the main adjustment direction 20.

The setting apparatus 69 can also comprise an electromagnet 42*b*, by means of which the shaped element 66 can be pushed into the notch 65. In particular, it can be provided, in this regard, that the shaped element 66 is held on a guide rod that is mounted in the electromagnet 42*b* in displaceable manner. Furthermore, a spring element can be provided, by means of which the shaped element 66 can be brought out of engagement with the notch 65 again when the electromagnet 42*b* is released. Furthermore, it can be provided that the force sensor 60 is coupled with the holding part 42*a* and thereby the acting force 54 can be determined.

In FIG. 11, yet another embodiment variant of the back gauge 15 is shown, wherein once again, the same reference symbols or component designations are used for the same parts as in the preceding FIGS. 1 to 10. In order to avoid unnecessary repetition, reference is made to the detailed description in the preceding FIGS. 1 to 10, i.e. this is pointed out.

As is evident from FIG. 11, it can be provided that the holding part 42*a* of the locking device 41 is configured in the form of a pneumatic cylinder, which has a press-down head 70, which interacts with a press-down projection 71 of the stop finger 18. The stop finger 18 can be pressed against an end stop by means of the drive head 70, and thereby can be pre-loaded in its working position 28. In particular, it can be provided that the force sensor 60 is configured as an end stop against which the stop finger 18 is pressed. In this way, the acting force 54 can be captured.

Furthermore, a buffer element 72 can be provided, which can be disposed next to the force sensor 60 and protects the force sensor 60 against excessive impact stress. The buffer element 72 can be configured in the form of a hydraulic shock absorber, for example.

When the pneumatic cylinder is moved out and the drive head 70 is pressed against the stop finger 18, the pneumatic cylinder itself can act as a second spring element 51, since the air that acts in the pneumatic cylinder is compressible. Thereby the spring force of the second spring 51 can be set by presetting the pressure in the pneumatic cylinder.

To deactivate the locking device 41, the pneumatic cylinder is moved into its retracted position, and thereby the stop finger 18 is released for movement in the main adjustment direction 20, wherein only the slight spring force of the first spring element 34 pre-loads the stop finger 18 into its working position 28.

The exemplary embodiments show possible embodiment variants, wherein it should be noted at this point that the invention is not restricted to the embodiment variants of the same that are specifically shown, but rather, instead, various combinations of the individual embodiment variants with one another are possible, and this variation possibility lies within the ability of a person skilled in the art and working in this technical field, on the basis of the teaching of the present invention concerning technical action.

The scope of protection is determined by the claims. However, the description and the drawings should be referred to for interpreting the claims. Individual characteristics or combinations of characteristics from the different exemplary embodiments shown and described can represent independent inventive solutions by themselves. The task on which the independent inventive solutions are based can be derived from the description.

All information regarding value ranges in the present description should be understood to mean that these include any and all partial ranges of them; for example, the information 1 to 10 should be understood to mean that all partial ranges, proceeding from the lower limit 1 and also including the upper limit 10 are also included; i.e. all partial ranges start with a lower limit of 1 or more and end at an upper limit of 10 or less, for example 1 to 1.7, or 3.2 to 8.1, or 5.5 to 10.

For the sake of good order, it should be pointed out, in conclusion, that for a better understanding of the structure, elements were shown not to scale and/or increased in size and/or reduced in size, in part.

REFERENCE SYMBOL LISTING

1 workpiece processing machine
2 bending machine
3 press brake
4 workpiece
5 contact surface
6 table beam
7 press beam
8 drive means
9 hydraulic cylinder
10 lower bending tool
11 upper bending tool
12 lower tool holder
13 upper tool holder
14 back gauge positioning system
15 back gauge
16 stop position
17 stop surface
18 stop finger
19 control apparatus
20 main adjustment position
21 base unit
22 coupling apparatus
23 basic part of base unit
24 lid part of base unit
25 attachment means of lid part
26 finger tip
27 recess

28 working position
29 linear guide
30 retracted position
31 guide carriage
32 guide rail
33 spacer of guide carriage
34 first spring element
35 end face of stop finger
36 end face of base unit
37 guide bolt
38 stop strip
39 conduit
40 locking ring
41 locking device
42*a* holding part
42*b* electromagnet
43 counter-element
44 magnet holder
45 attachment means
46 guide rod
47 first mounting cheek
48 second mounting cheek
49 spacer of mounting cheek(s)
50 end region of guide rod
51 second spring element
52 stop element
53 attachment means
54 acting force
55 buffer element
56 displacement path
57 sensor element
58 second end region of guide rod
59 rear wall of stop finger
60 force sensor
61 display element
62 contact surface of electromagnet
63 contact surface of counter-element
64 articulated mounting
65 notch
66 shaped element
67 locking direction
68 wedge surface
69 setting apparatus
70 press-down head
71 press-down projection
72 buffer element

The invention claimed is:

1. A back gauge (15) for a back gauge positioning system (14) of a bending machine (2), the back gauge (15) comprising a stop finger (18) on which at least one stop surface (17) is configured, and a base unit (21) that is configured for coupling with the back gauge positioning system (14), wherein the stop finger (18) is coupled with the base unit (21) by means of a linear guide (29), and the stop finger (18) can be displaced relative to the base unit (21) between a pushed-forward working position (28) and a retracted position (30), wherein the stop finger (18) and the base unit (21) are coupled with a reset apparatus in a form of a first spring element (34), by means of which the stop finger (18) is pre-loaded into the working position (28), wherein a switchable locking device (41) is configured, by means of which the stop finger (18) in a first state can optionally be locked in the working position (28) or in a second state is released into its retracted position (30) for displacement counter to the spring force of the first spring element (34), wherein the locking device (41) is configured such that switching the locking device (41) from the second state into the first state is reached by an activation energy, wherein a second spring element (51) is provided, which is coupled with the stop finger (18) and the base unit (21) with the interposition of the locking device (41), wherein when the locking device (41) is locked, the stop finger (18) is fixed in place in the working position (28) by means of the second spring element (51), wherein the stop finger is pre-loaded into the working position with the spring force of the second spring element, in addition to the spring force of the first spring element, wherein when the locking device is activated, the second spring element and the first spring element act counter to displacement of the stop finger, wherein when the locking device is deactivated, the second spring element no longer acts counter to displacement of the stop finger, wherein the locking device (41) comprises a holding part (42*a*), wherein the stop finger (18) can be locked in place relative to the base unit (21) by applying the activation energy in the holding part (42*a*), wherein the holding part (42*a*) of the locking device (41) is held on the base unit (21) non-displaceably relative to the base unit, in a main adjustment direction (20), wherein the locking device (41) has a counter-element (43) that interacts with the holding part (42*a*) and is disposed on a guide rod (46), wherein the guide rod (46) is mounted at least on a first mounting cheek (47), wherein the counter-element (43) is disposed on an end region (50) of the guide rod (46) and the second spring element (51) is disposed on the guide rod (46) opposite to the counter-element (43), with reference to the first mounting cheek (47), and wherein a stop element (52) for the second spring element (51) is positioned on the guide rod (46), and wherein the second spring element (51) is configured as a pressure spring and held on the guide rod (46) between the first mounting cheek (47) and the stop element (52), whereby the stop element (52) is pre-loaded away from the first mounting cheek (47) by means of the second spring element (51), and thereby the counter-element (43) is pre-loaded toward the first mounting cheek (47).

2. The back gauge according to claim 1, wherein the locking device (41) has a mechanically acting locking unit.

3. The back gauge according to claim 2, wherein the mechanically acting locking unit of the locking device (41) is configured for production of a shape-fit connection between the stop finger (18) and the base unit (21).

4. The back gauge according to claim 1, wherein the second spring element (51) has a greater spring rigidity than the first spring element (34) and/or the second spring element (51) has a greater pre-load than the first spring element (34).

5. The back gauge according to claim 1, wherein the guide rod (46) is mounted in the first mounting cheek (47) with mounting play, so that an angular rotation and/or radial displacement between the guide rod (46) and the first mounting cheek (47) is made possible.

6. The back gauge according to claim 1, wherein the guide rod (46) is additionally mounted on a second mounting cheek (48), wherein the first mounting cheek (47) and the second mounting cheek (48) are disposed at a distance (49) from one another.

7. The back gauge according to claim 1, wherein the holding part (42*a*) is configured as an electromagnet (42*b*) and wherein the counter-element (43) is configured as a disk that interacts with the electromagnet (42*b*) and is disposed on the guide rod (46) on an end face of the guide rod (46), wherein the electromagnet (42*b*) and the counter-element (43) lie against one another at contact surfaces (62, 63).

8. The back gauge according to claim 7, wherein the electromagnet (42*b*) and/or the counter-element (43) are held on an articulated mounting (64), so that the contact surfaces (62, 63) can be oriented parallel to one another.

9. The back gauge according to claim 8, wherein the articulated mounting (64) comprises a universal joint or a ball-head joint.

10. The back gauge according to claim 1, wherein a buffer element (55) is provided, which serves for damping the stop finger (18) when it is displaced into the retracted position (30).

11. The back gauge according to claim 1, wherein the linear guide (29) is configured in the form of a recirculating ball bearing guide.

12. The back gauge according to claim 1, wherein the linear guide (29) comprises a guide carriage (31), and wherein the guide carriage is coupled with the stop finger (18) and comprises a guide rail (32) that is coupled with the base unit (21).

13. The back gauge according to claim 1, wherein a force sensor (60) is provided, which is configured for capturing the amount of an acting force (54).

14. The back gauge according to claim 1, wherein at least one display element (61) for display of the status of the locking device (41) is disposed on the stop finger (18).

15. The back gauge according to claim 1, wherein a sensor element (57) is provided, which serves for capture of a relative movement and/or relative position between the stop finger (18) and the base unit (21).

16. The back gauge according to claim 15, wherein the sensor element (57) is configured in the form of an inductive sensor.

17. A method for positioning of the back gauge (15) according to claim 1, by means of a back gauge positioning system (14) of a bending machine (2), wherein the method comprises the following method steps:

setting of a displacement mode of the back gauge (15), wherein the locking device (41) is not locked and wherein the stop finger (18) is pre-loaded into the working position (28) by means of the reset apparatus;

displacement of the back gauge (15) by means of the back gauge positioning system (14) into a predetermined stop position (16);

locking of the stop finger (18) in the working position (28) by means of the locking device (41).

18. The method according to claim 17, wherein the back gauge comprises a sensor element (57) serving for capture of a relative movement and/or relative position between the stop finger (18) and the base unit (21); and wherein the relative movement and/or relative position between the stop finger (18) and the base unit (21) is monitored during the displacement mode of the back gauge (15), by means of the sensor element (57), and if a relative movement between the stop finger (18) and the base unit (21) is captured during the displacement of the back gauge (15), the displacement movement is stopped.

19. A back gauge (15) for a back gauge positioning system (14) of a bending machine (2), the back gauge (15) comprising a stop finger (18) on which at least one stop surface (17) is configured, and a base unit (21) that is configured for coupling with the back gauge positioning system (14), wherein the stop finger (18) is coupled with the base unit (21) by means of a linear guide (29), and the stop finger (18) can be displaced relative to the base unit (21) between a pushed-forward working position (28) and a retracted position (30), wherein the stop finger (18) and the base unit (21) are coupled with a reset apparatus in a form of a first spring element (34), by means of which the stop finger (18) is pre-loaded into the working position (28), wherein a switchable locking device (41) is configured, by means of which the stop finger (18) in a first state can optionally be locked in the working position (28) or in a second state is released into its retracted position (30) for displacement counter to the spring force of the first spring element (34), wherein the locking device (41) is configured such that switching the locking device (41) from the second state into the first state is reached by an activation energy, wherein a second spring element (51) is provided, which is coupled with the stop finger (18) and the base unit (21) with the interposition of the locking device (41), wherein when the locking device (41) is locked, the stop finger (18) is fixed in place in the working position (28) by means of the second spring element (51), wherein the stop finger is pre-loaded into the working position with the spring force of the second spring element, in addition to the spring force of the first spring element, wherein when the locking device is activated, the second spring element and the first spring element act counter to displacement of the stop finger, and wherein when the locking device is deactivated, the second spring element no longer acts counter to displacement of the stop finger.

* * * * *